US005988936A

United States Patent [19]

Smith

[11] Patent Number: 5,988,936

[45] Date of Patent: Nov. 23, 1999

[54] SLIP FORM CONTROL SYSTEM FOR TIGHT RADIUS TURNS

[75] Inventor: Randall K. Smith, McHenry, Ill.

[73] Assignee: Miller Formless Co., Inc., McHenry, Ill.

[21] Appl. No.: 08/988,440

[22] Filed: Dec. 11, 1997

[51] Int. Cl.[6] ..... E01C 23/07

[52] U.S. Cl. ..... 404/84.2; 404/84.05; 404/84.5; 404/83

[58] Field of Search ..... 404/84.2, 84.8, 404/84.05, 84.11, 83; 56/10.2 R, 10.2 D, DIG. 15; 172/4, 5

[56] References Cited

U.S. PATENT DOCUMENTS 3,606,827 9/1971 Miller et al. .
3,749,505 7/1973 Miller et al. .
4,185,712 1/1980 Bulger ..... 404/84
4,497,256 2/1985 Hansmann et al. ..... 56/10.2 D
5,499,684 3/1996 Stratton ..... 172/4.5

*Primary Examiner*—Thomas B. Will
*Assistant Examiner*—Raymond W Addie
*Attorney, Agent, or Firm*—Leydig, Voit & Mayer, Ltd.

[57] ABSTRACT

A machine for distributing a material through a working unit along a ground surface in a direction established by an external reference includes front and rear devices for moving the machine along the ground surface, a steering control unit that functions to controlling the steering of the front and rear devices and, mounted along one side, first, second, and third steering sensors. The first, second and third steering sensors generate output signals indicative of their position with respect to the external reference. A processor unit utilizes the output signals generated by the first, second, and third steering sensors in a predetermined manner to cause the steering control unit to direct the machine generally in the direction established by the external reference.

12 Claims, 6 Drawing Sheets

SLIP FORM CONTROL SYSTEM FOR TIGHT RADIUS TURNS

FIELD OF THE INVENTION

This invention relates generally to machines for use in handling hardenable material such as concrete and, more particularly, to a control system for a machine adapted for use in handling hardenable material that uses an adaptive steering sensor arrangement for navigating tight radius turns and the like.

BACKGROUND OF THE INVENTION

In the prior art, machines for particular use in handling formable, hardenable material such as concrete are known. For example, U.S. Pat. Nos. 3,606,827 and 3,749,505 disclose a self-propelled, self-steering, and self-leveling machine adapted to for handling, conveying, compacting and distributing formable material upon or along a work location. The formable material is distributed in a desired grade, slope, and directional configuration as defined by an external reference, such as a string line guide. The string line guide extends along a desired path of travel which is followed by the machine.

In one embodiment, the machine includes a material receiving hopper disposed on one of its lateral sides. A conveyor elevates the formable material from the receiving hopper and transfers the material to a compaction hopper disposed on the opposite of the machine. The material is thereafter passed by gravity feeding to a working tool, for example, a mule shoe.

A pair of drive units are utilized to provide desired movement of the machine. These are implemented as front and rear track-type crawler assemblies. To effectuate steering of the machine, a sensor arrangement is disposed to detect the directional position of the string line guide and to detect the elevation of the string line guide. For detecting the position of the string line guide, a pair of electrical steering sensors are utilized. Each includes a bar member pressed into engagement with the string line guide by a biasing spring. A first one of the sensors is associated with the forward moving device. The other sensor is associated with the rearward moving device. The machine automatically moves the traveling sensor perpendicular to the line of travel to provide integrated steering control of the front and rear crawler assemblies.

While such machines generally work for their intended purpose, the two-sensor system fails to allow the curb-forming machine to be automatically steered around tight radius turns or sharp curves. As a result, the machine requires a override for the steering system such that a user is required to maneuver the machine around tight radius turns or the like. However, some degree of precision is lost when the automatic control is disengaged in favor of manual control. That is, in most cases the machine can no longer fulfill the purpose for which it is intended, i.e., to form smooth curbs or the like. Accordingly, a need exists in the art for an improved curb-forming machine that overcomes this noted deficiency.

SUMMARY OF THE INVENTION

In accordance with this need, the invention provides an improved control arrangement for a curb-forming machine adapted for handling formable material. The machine comprises a body with front and rear devices depending therefrom for moving the machine along a ground surface. A steering control unit controls the steering of the front and rear devices. The curb-forming machine also comprises first, second, and third steering sensors arranged in a generally linear array. The first, second and third steering sensors generate an output signal indicative of their position with respect to an external reference.

A processor unit is coupled to the first, second and third steering sensors and the steering control unit. The processor unit receives the output signals generated by the first, second, and third steering sensors. The processor selectively utilizes position information from one or more of the sensors and provides appropriate control signals to the steering control unit to automatically direct the machine generally along a path established by the external reference. In this manner, the curb-forming machine may automatically follow the external reference without regard to tight radius turns or the like.

More specifically, during normal operation, the curb-forming machine uses position information generated by the first and second steering sensors positioned proximate to the first and second steering units, respectively. However, if the first sensor detects a variation in the path of travel established by the external reference that exceeds a threshold, the processor unit uses position information generated by the third steering sensor to automatically direct the machine generally in the direction established by the external reference. This usage an additional sensor, positioned at an intervening location with respect to the first and second sensors, preferably at a fixed position with respect to a location centered between the front and rear moving devices, continues until such time that the machine navigates the tight curvature. Thereafter, the curb-forming machine again transitions to the first operating mode and uses the output signals generated by the first and second steering sensors. In this way, the machine is automatically directed along the path of travel established by the external reference. This arrangement permits automatic steering of the curb-forming machine even when sharp curves are encountered. The resultant material formation is smooth and without visible errors.

A better understanding of the objects, advantages, features, properties and relationships of the invention will be obtained from the following detailed description and accompanying drawings that set forth an illustrative embodiment and are indicative of the various ways in which the principles of the invention may be employed.

BRIEF DESCRIPTION OF THE DRAWINGS

For a better understanding of the invention, reference may be had to the preferred embodiment shown in the following drawings in which.

DETAILED DESCRIPTION OF THE PREFERRED EMBODIMENTS

Figure 1:
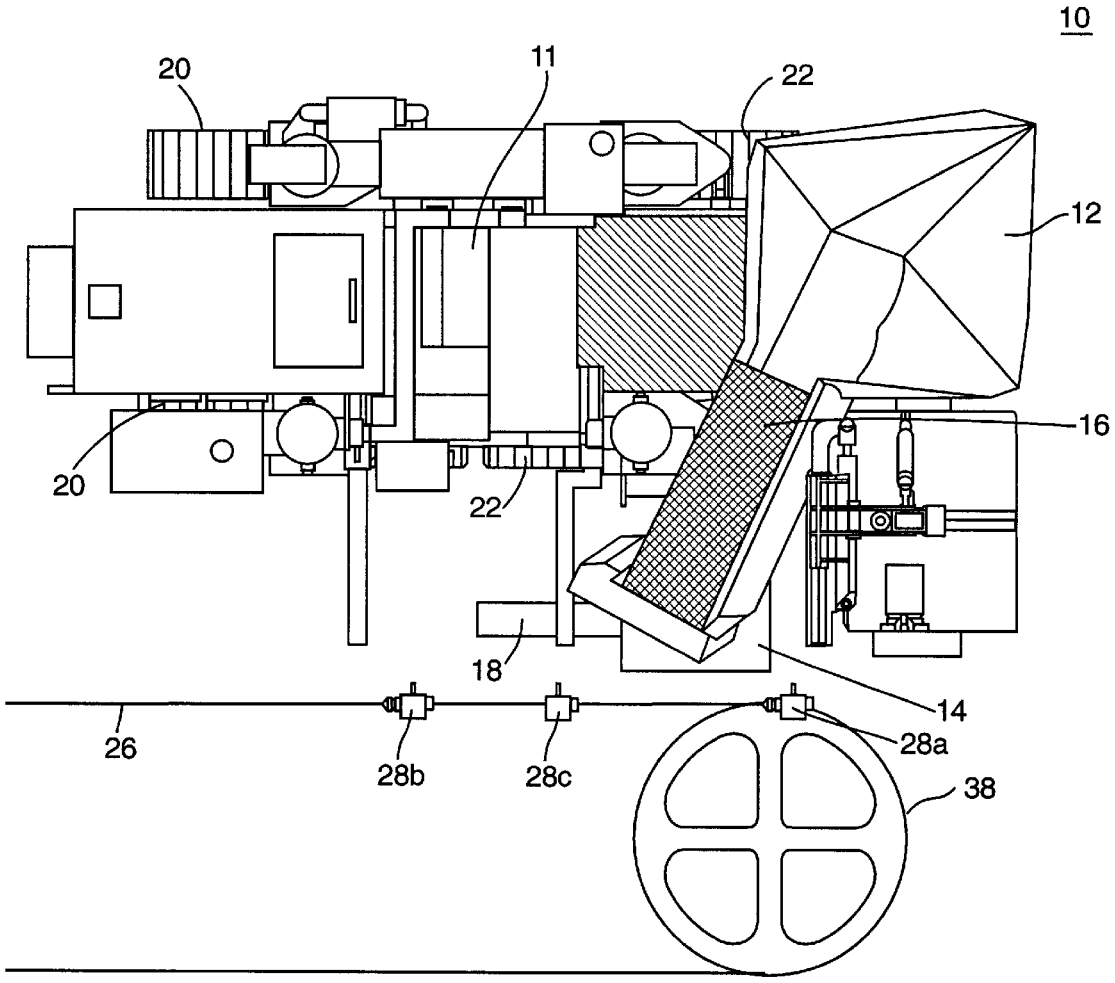
FIG. 1 illustrates a top plan view in diagrammatic form showing a curb-forming machine constructed in accordance with the present invention moving along a path of travel toward a tight radius turn.

Generally, the present invention relates to an improved material handling machine and a control system used in conjunction with such a machine. The machine selectively uses position information from an array of position sensors in various modes of operation such that tight radius turns and other geometries can readily be navigated. By way of example, the invention provides the capability to navigate end caps on paved islands or other close curb functions. While the invention can be used in connection with any type of material handling machine, it will be described hereinafter in the context of a curb-forming paver machine disposed to lay a hardenable material such as concrete.

In this regard, the subject invention is directed to an improvements in a curb-forming machine of the general type described in U.S. Pat. Nos. 3,606,827 and 3,749,505. Each of these patents are incorporated by reference herein their entirety. For the sake of brevity, those elements and components of conventional construction and described in U.S. Pat. Nos. 3,606,827 and 3,749,505 will not be discussed in detail hereinafter.

Referring now to the drawings, wherein like reference numerals refer to like elements, there is illustrated in FIGS. 1–4 a curb-forming machine 10 constructed in accordance with the subject invention. Generally, the curb-forming machine 10 comprises a generally rectangular body 11 having a receiving hopper 12 secured at one of the lateral sides thereof. The receiving hopper that is adapted to receive a formable, hardenable material such as concrete from the chute of a concrete mixing truck (not shown). FIGS. 1 through 4 also illustrate a feed hopper 16 disposed on the opposite side of the body 11. A conveyor 16 is utilized to transfer concrete from the receiving hopper 14 to the feed hopper 14 as will be understood by those skilled in the art. The feed hopper 14 is, in turn, connected to a working unit or mold 18, such as a slip form. The working unit 18 utilizes the concrete supplied from the feeding hopper 14 to lay a curb or gutter according to its design. In the preferred embodiment, the slip form 18 has its end in alignment with a position that is located equidistant from front and rear crawler assemblies 20, 22.

The curb-forming machine 10 is propelled by the pair of independently controllable moving devices or crawler assemblies 20, 22. In the preferred embodiment, one of the moving devices is implemented as a rear crawler assembly 20, disposed proximate to the rear of the machine body 11. A second or forward crawler assembly 22 is disposed forward of the first crawler assembly 20. Each of the crawler assemblies 20, 22 comprises a pair of opposed tracks that traverse appropriate drive mechanisms as will be understood by those skilled in the art.

In the preferred embodiment, the front and rear crawler assemblies 20, 22 are independently controlled. For example, in one operating mode, the crawler assemblies are steered in a coordinated mode wherein the front and rear crawler assemblies turn in opposite directions. In this mode, the machine may navigate tight radius turns as described below. In another crab-type operating mode, the tracks are turned in the same direction. Alternatively, either the front or rear crawler assemblies may be independently steered.

The curb-forming machine 10 travels on an established and prepared grade under the guidance of an external reference. Preferably, the reference is a string line guide 26 that is supported on string line posts (not shown). The string line guide 26 is preferably located outside of the edge of the grade and held taut by a plurality of spaced arms in a manner well known in the art. It will be understood that the string line guide 26 is to represent the desired path of travel and direction of the curbing to be laid along and upon the edge of the grade.

In accordance with the invention, the curb-forming machine 10 is accurately guided along the string line guide 26 with a sensor arrangement disposed to detect the presence of the string line guide 26 in various modes of operation, thereby detecting the relative position of the machine. In this regard, at least three steering sensors are provided in a linear array. As shown in FIGS. 1–5, steering sensors 28*a*, 28*b* and 28*c* are located in fixed relation to the machine body 11. The first sensor 28*a* is preferably located in alignment with the center of the tracks for the front crawler assembly 22 in laterally spaced relation therefrom. Similarly, the second sensor 28*b* is disposed in alignment with the center of the rear crawler assembly 20, and spaced laterally therefrom. The third sensor 28*c* is disposed at a selected location between the first and second sensors. In the preferred embodiment, the third sensor 28*c* is generally located at a selected distance from the rear edge or discharge of the working unit 18. Most preferably, the third sensor 28*c* is offset approximately one-foot forward from the working unit discharge which itself is aligned with a location centered between the crawler assemblies 20, 22. In addition, a plurality of elevation sensors (not shown) detect the elevation of the string line guide 26. As the elevation sensors and their use to provide a means for adjusting the level of the curb-forming machine 10 form no part of the subject invention, they are not discussed in further detail herein.

As noted above, the steering sensors 28*a*, 28*b* and 28*c* are mounted to the side of the curb-forming machine 10 and are designed to sense the direction of the string line guide 26 as a function of their positional relationship with respect to the guide. Inasmuch as the steering sensors 28*a*, 28*b* and 28*c* are arranged in a generally linear orientation with respect to one another and are mounted to the curb-forming machine 10, it will be understood that their positional relationship with respect to the string line guide 26 corresponds to the positional relationship of the curb-forming machine 10 with respect to the string line guide 26.

The steering sensors 28*a*, 28*b* and 28*c* are conventionally constructed and include a wand or bar member that is designed to be urged against the string line 26 by a biasing means. In particular, the biasing means functions to bias the bar member away from the curb forming machine 10 such that contact with the string line 26 influences the orientation of the bar member with respect to vertical. The bar member, in turn, is connected to a device, such as an electrical switch, that generates an output signal, such as a voltage signal. This signal is indicative of the orientation of the bar member with respect to vertical and, accordingly, the position of the sensor with respect to the string line guide 26.

In a preferred embodiment, steering sensor 28*a* is mounted at a location proximate to the center of the front crawler assembly 22 and steering sensor 28*b* is mounted at a location proximate to the center of the rear crawler assembly 20. Between the steering sensors 28*a* and 28*b*, the steering sensor 28*c* is mounted at a location that is offset generally forward from the midpoint of the crawler assemblies. For example, when utilized in connection with a curb-forming machine 10 of conventional size, the steering sensor 28*c* is preferably mounted at a location that is offset approximately one foot forward from the mid-point. This positioning may be varied slightly to account for changes in terrain or for relatively large radius turns.

Figure 5:
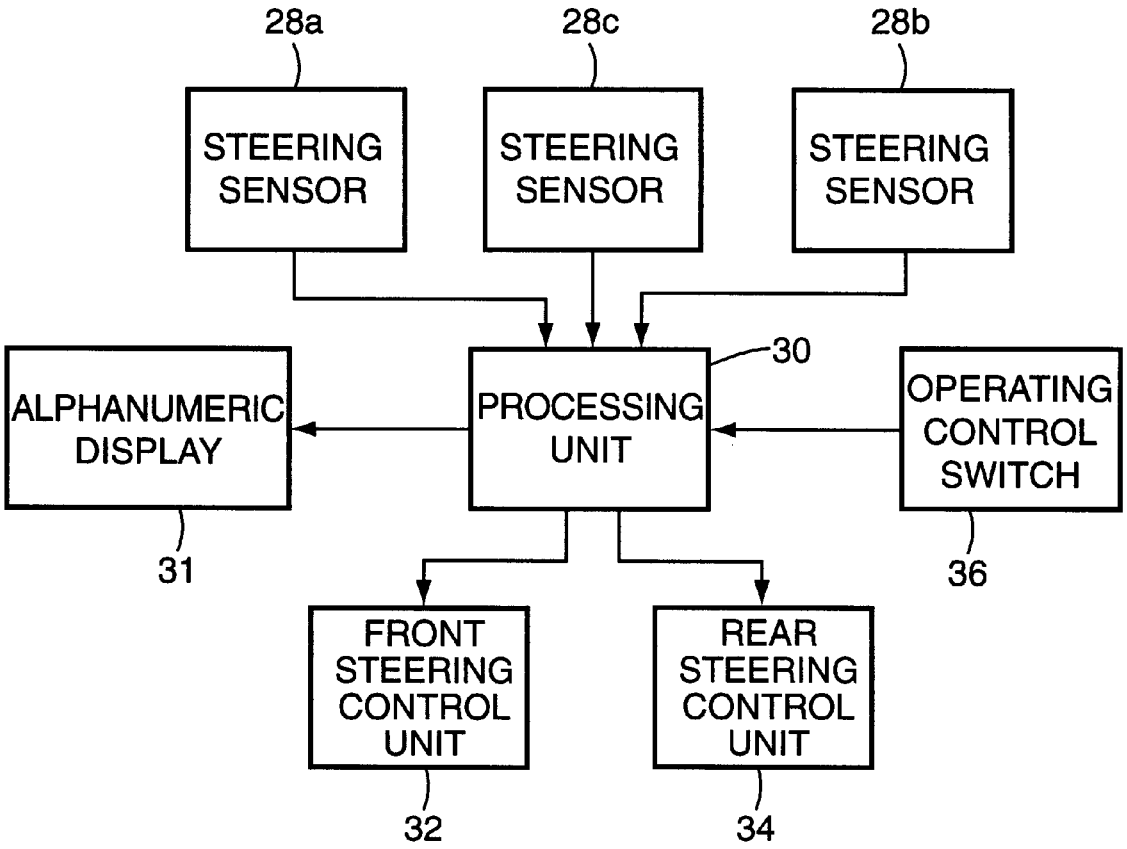
FIG. 5 illustrates a simplified block diagram representation of a control system for the curb-forming machine of FIGS. 1–4.

Turning to FIG. 5, the steering sensors 28*a*, 28*b* and 28*c* are electrically connected to a processor unit 30 of the curb-forming machine 10. The processor unit 30 operates in a logical fashion to provide control signals to a rear steering unit 32 and a front steering unit 34. These control signals are developed as a function of the output signals received from the steering sensors 28*a*, 28*b* and 28*c*. The front and rear steering units 32 and 34 are also of conventional construction and are used to control the orientation and speed of the rear and front crawler assemblies 20, 22 in a known manner. An alphanumeric display 31 may also be connected to the processor unit 30 for use in providing feedback to an operator regarding the state of operation of the curb-forming machine 10.

Figure 6:
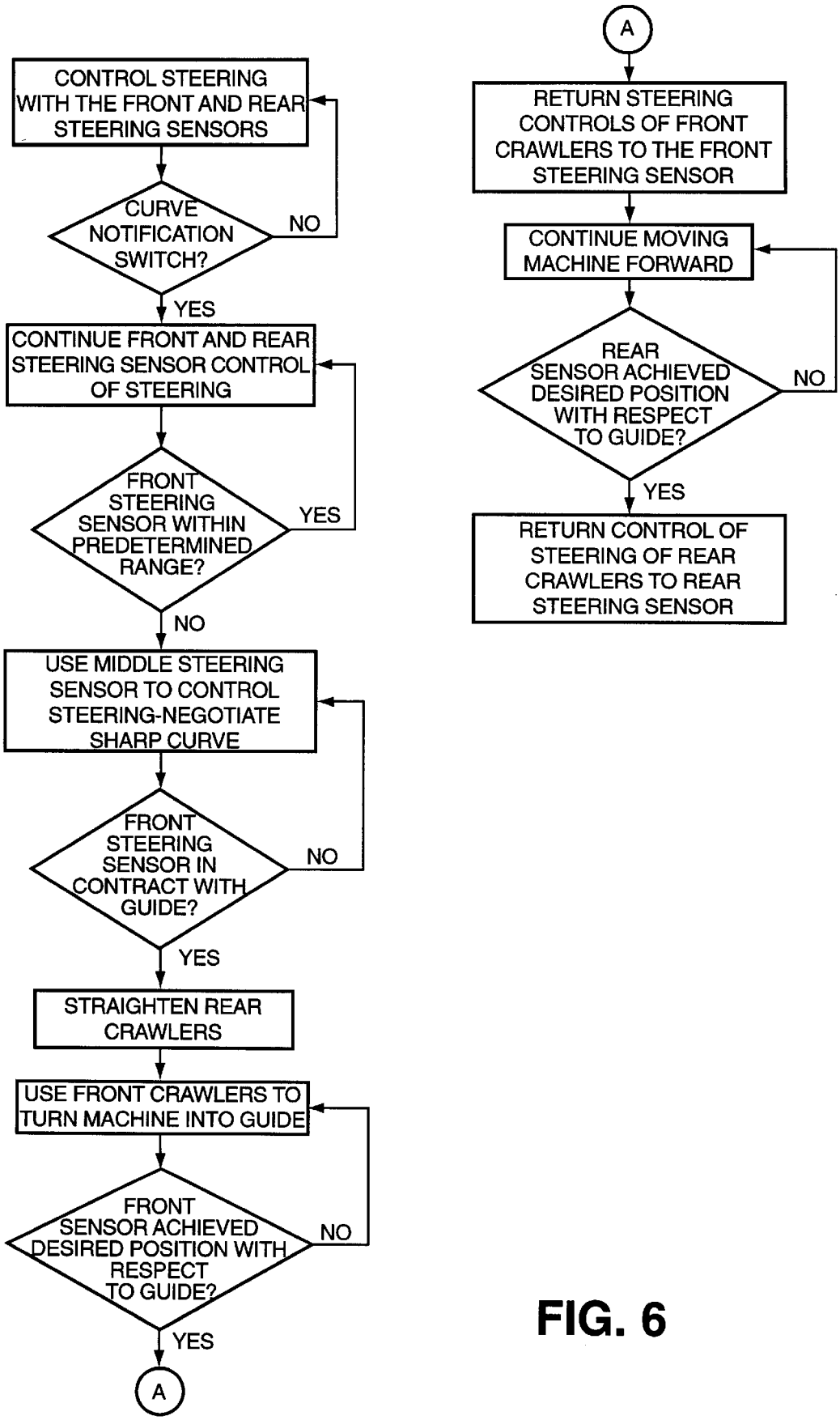
FIG. 6 illustrates a flow chart of the control sequences utilized in connection with the control system illustrated in FIG. 5.

FIG. 6 is a flow chart illustrating the sequence of control for the machine in a mode of operation that permits navigation of a tight radius turn. During operation, when the curb-forming machine 10 approaches a turn such as the sharp curve 38 illustrated in FIG. 1, the operator activates a switch 36. Such action functions to alert the processor of the upcoming event, namely, a tight radius turning mode of operation. During this time, the curb-forming machine 10 continues to travel along the string line guide 26 utilizing the first and second steering sensors 28*a* and 28*b* in a conventional manner to control the direction of travel.

This conventional control of the curb-forming machine 10 continues until such time as the front steering sensor 28*a* generates an output signal that is indicative of a loss of a predetermined amount of contact with the string line guide 26. In particular, this output signal is generated when the contact between the bar of the steering sensor 28*a* and the string line guide 26 is insufficient to maintain the bar within a predetermined range of vertical orientation. Upon the receipt of this output signal, the processor unit 30 transfers steering control from operating as a function of the output signals generated by steering sensors 28*a* and 28*b* to operate as a function of the output signal generated by the third steering sensor 28*c*.

Figure 2:
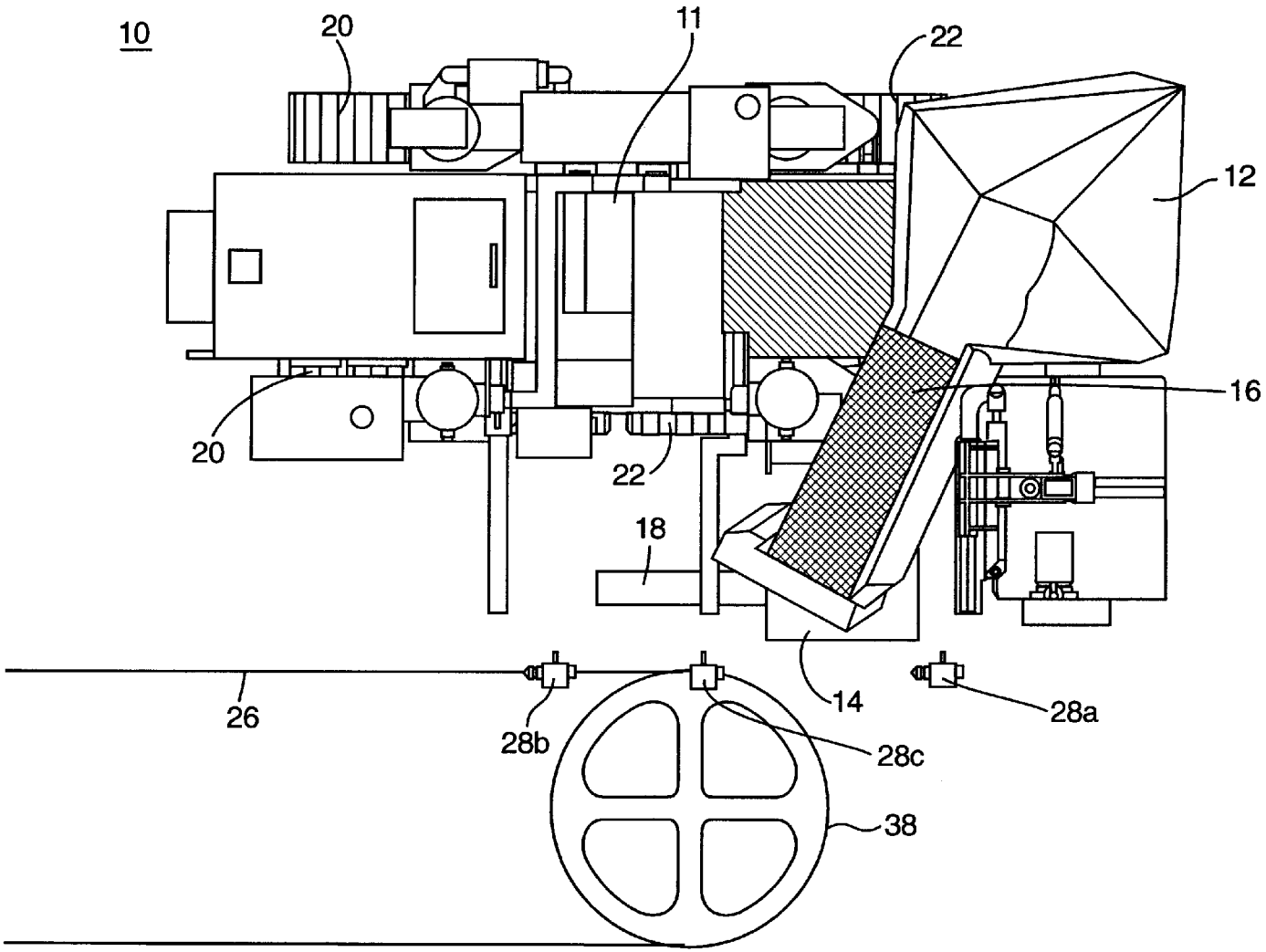
FIG. 2 is another plan view of the curb-forming machine of FIG. 1 as it begins to navigate the tight radius turn.
Figure 3:
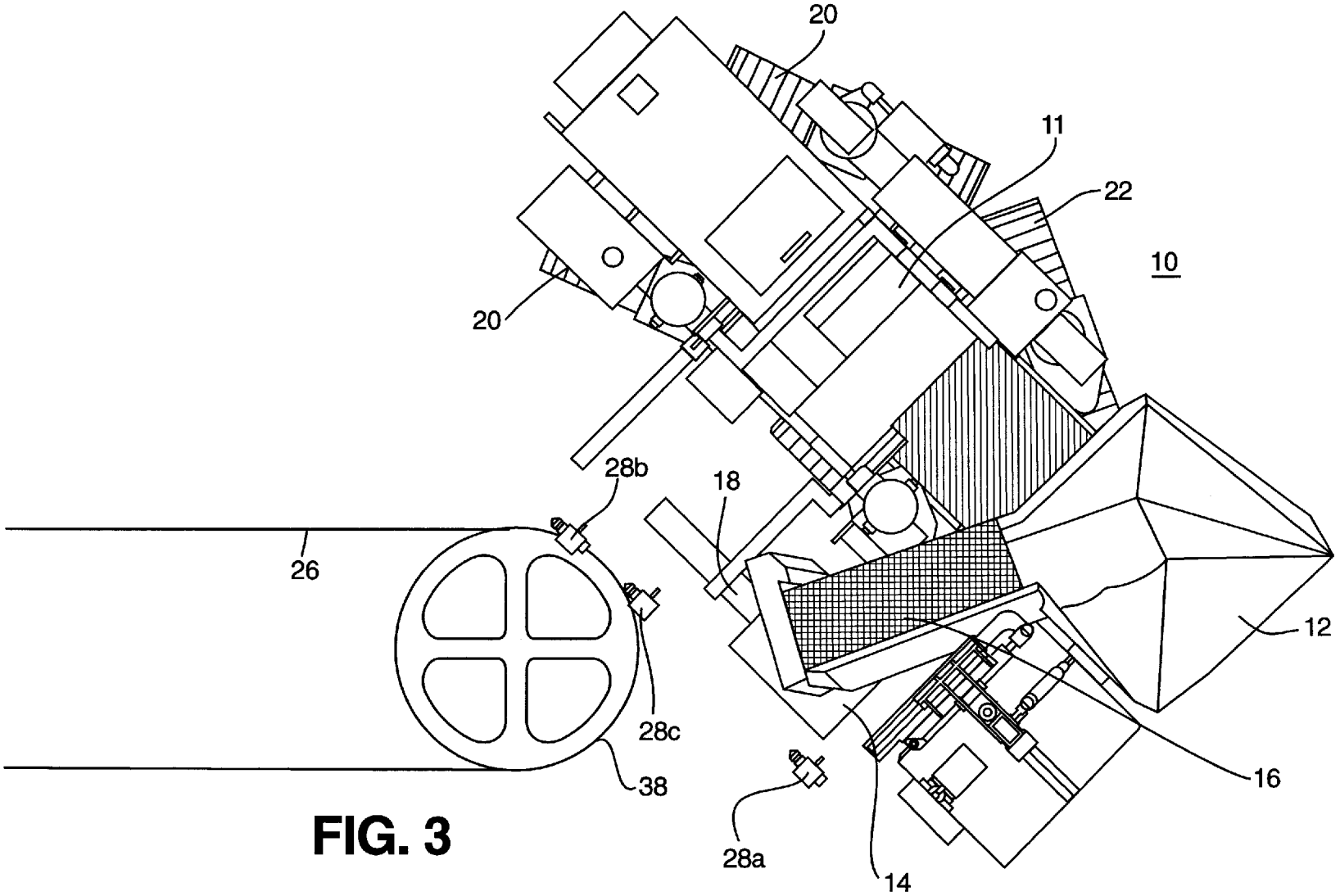
FIG. 3 is a further plan view of the curb-forming machine of FIG. 2 illustrating a further navigation of the tight radius turn.

The curb-forming machine 10 then continues to travel in a generally straight line, as illustrated in FIG. 2, during which time the steering sensor 28*c* provides the processor unit 30 with output signals indicative of the vertical orientation of its bar as influenced by the string line 26. As the curb-forming machine 10 enters the sharp curve 38, the vertical orientation of the third steering sensor bar changes as a result of its loss of contact with the string line guide 26. The change in the position of the steering sensor 28*c* with respect to the string line guide 26 results in a change in the output signal the sensor 28*c* generates. If the output signals from the steering sensor 28*c* fall outside of an acceptable range, the processor unit 30 provides appropriate control signals to the steering control units 32 and 34 such that the curb-forming machine 10 may be turned around the tight radius. As illustrated in FIG. 3, the rear and front crawler assemblies 20 and 22 are turned in a coordinated mode in order to reposition the steering sensor 28*c* with respect to the string line guide 26 such that its output signals fall within the acceptable range. This procedure is repeated as the curb forming machine 10 negotiates the sharp curve 38 whereby a generally fixed positional relationship between the string line guide 26 and the back of the working unit 18 is maintained.

Figure 4:
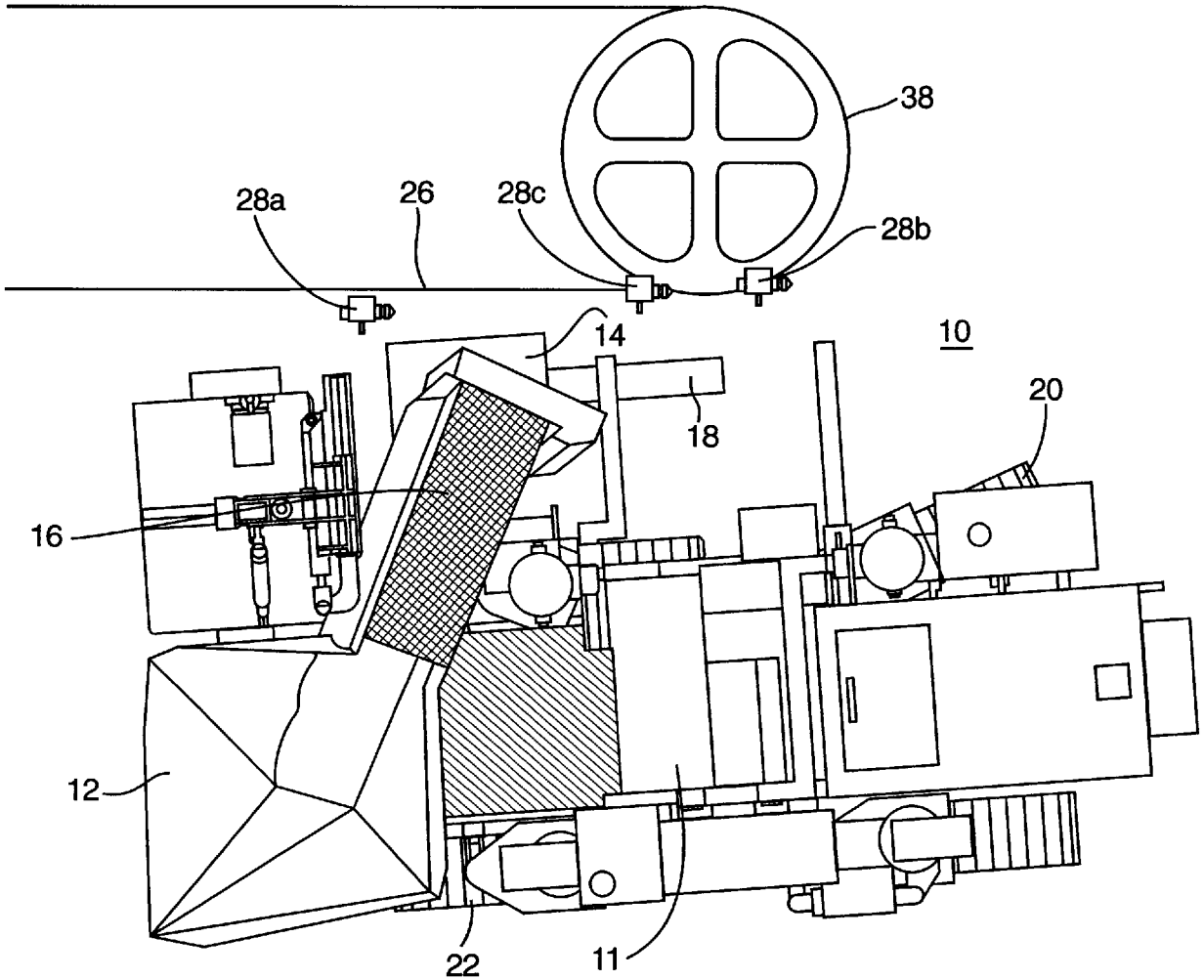
FIG. 4 is another plan view of the curb-forming machine of FIG. 1 as it moves out of the tight radius turn and continues along the path of travel.

The curb-forming machine 10 continues in this coordinated mode until such time as the front steering sensor 28*a* once again comes back into contact with the sting line guide 26, as illustrated in FIG. 4. Specifically, as the front steering sensor 28*a* is moved toward the string line guide 26, the bar of the steering sensor 28*a* is forced by the string line guide 26 back towards a substantially vertical orientation. The processor unit 30 monitors the output signal generated by the first steering sensor 28*a*, which corresponds to the orientation of the bar. When the bar achieves a predetermined vertical orientation, the rear crawler assembly 20 are steered to a straight position. During this time, the curb-forming machine 10 continues turn toward the string line guide 26 by the front crawler assembly as a function of the output signal generated by the third steering sensor 28*c*.

When the bar associated with the steering sensor 28*a* achieves a vertical orientation that is substantially the same as the vertical orientation of the bar of the steering sensor 28*c*, control of the front crawler assembly 22 is provided as a function of the output signal generated by steering sensor 28*a*. Similarly, control of the rear crawler assembly 20 is provided as a function of the output signal generated by steering sensor 28*b* when that sensor comes in contact with the string line 26 and the orientation of its bar with respect to vertical is within a predetermined range. At this point, the curb-forming machine 10 has returned back to a conventional steering operating mode without causing a jerk or jog in the crawler assemblies 20, 22.

Accordingly, many advantages flow from the invention described herein. For example, the invention provides a for automatic steering around sharp curves. Furthermore, the curb-forming machine provides a smoothed course of travel that eliminates any jerking of the crawler assemblies that typically arise from transitions into and out of manual control. It has been found that the machine can readily handle turns of approximately two to five feet without modification in software or otherwise. For larger radius turns, approximate modification may be made in software for steering around the larger radius. Alternatively, the location of the third steering sensor 28*c* may be moved slightly in a longitudinal direction with respect to the machine center. For example, the sensor may be positioned slightly rearwardly (i.e., by one-half to one inch) to negotiate the larger radius turn. Alternatively, the sensor 28*c* may be moved slightly forward for smaller radius turns. These advantages allow the curb-forming machine to lay concrete that is smoother aesthetically and that conforms to local and state specifications when required.

While specific embodiments of the invention have been described in detail, those skilled in the art will appreciate that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalent thereof.

What is claimed is:

1. A machine for the controlled distribution of a formable material through a working unit along a ground surface in a direction established by an external reference, the machine comprising:

front and rear devices for moving the machine along the ground surface;

first and second steering control units associated with the front and rear devices respectively disposed to control the steering of the front and rear devices;

first, second, and third steering sensors mounted to one side of the machine body, each generating an output signal indicative of their position with respect to the external reference; and a processor unit linked to the first, second and third steering sensors and the steering control unit whereby the processor unit utilizes the output signals generated by the first, second, and third steering sensors in a predetermined manner to cause the steering control unit to direct the machine generally in the direction established by the external reference wherein the first, second and third steering sensors are generally linearly arranged and wherein the processor utilizes the output signal generated by outside two of the first, second and third steering sensors to cause the steering control unit to direct the machine generally in the direction established by the external reference excepting when the direction of the external reference is substantially curved wherein the processor utilizes the output signal generated the interior one of the first, second and third steering sensors to cause the steering control unit to direct the machine generally in the direction established by the external reference.

2. The machine as recited in claim 1, wherein the front and rear devices comprise front and rear crawlers.

3. The machine as recited in claim 1, wherein the external reference comprises a string line guide and the first, second and third steering sensors are adapted to monitor their position with respect to the string line guide.

4. The machine as recited in claim 3, wherein the first, second and third steering sensors each include a downwardly extending bar that is biased away from the machine for use in monitoring their position with respect to the string line guide as a function of the vertical orientation of the bar.

5. The machine as recited in claim 4, wherein the first, second and third steering sensors each comprise an electrical switch connected to the bar whereby the electrical switch generates an output signal indicative of the vertical orientation of the bar.

6. A method for controlling the direction of movement of a machine for the controlled distribution of a material through a working unit along a ground surface in a direction established by an external reference, the machine having first, second, and third generally linearly arranged steering sensors each adapted to generate an output signal indicative of their position with respect to the external reference, the method comprising the steps of:

utilizing the output generated by the outside two of the first, second and third steering sensors to direct the machine generally in the direction established by the external reference; and if the direction established by the external reference curves sharply, utilizing the output generated by the interior one of the first, second and third steering sensors to direct the machine generally in the direction established by the external reference until such time that the direction of the external reference exits the curve whereafter the output generated by the outside two of the first, second and third steering sensors is again utilized to direct the machine generally in the direction established by the external reference.

7. The method as recited in claim 6, further comprising the steps of accepting a notification that the external reference is going to curve sharply and, in response thereto, readying the machine to transition to utilizing the interior one of the first, second and third steering sensors to direct the machine generally in the direction established by the external reference.

8. The method as recited in claim 7, further comprising the step of transitioning to the use of the interior one of the first, second and third steering sensors to direct the machine generally in the direction established by the external reference after the forward positioned one of the first, second and third steering sensors generates an output signal that is not within a predetermined range.

9. The method as recited in claim 8, further comprising the step of monitoring the output signal generated by the forward one of the first, second and third steering sensors to determine when the external reference exits the curve.

10. The method as recited in claim 9, further comprising the step of steering the machine into the external reference until the forward one of the first, second and third steering sensors generates an output signal within a predetermined range whereafter the forward one of the first, second and third steering sensor is again utilized to direct the machine generally in the direction established by the external reference.

11. The method as recited in claim 10, further comprising the steps of monitoring the rearward one of the first, second and third steering sensors and, when the rearward one of the first, second and third steering sensors generates an output signal within a predetermined range, again utilizing the rearward one of the first, second and third steering sensor to direct the machine generally in the direction of the external reference.

12. A sensing arrangement for use with a machine adapted for applying hardenable material through a working unit along a ground surface, the sensing arrangement detecting the presence of an external reference in first and second operating modes, comprising:

a linear sensor array fixedly attached to the machine in spaced relation with respect to the reference, the sensor array including a first position sensor developing first sensing signals indicative of the presence or absence of the reference, a second position sensor, disposed rearward of said first position sensor, said second position sensor developing second sensing signals indicative of the presence or absence of the reference, and a third position sensor, disposed between said first and third position sensors, said third position sensor developing third sensing signals indicative of the presence or absence of the reference; and, a processing unit for adaptively utilizing said first and third sensing signals in the first operating mode, and for utilizing said second sensing signals in the second operating mode, said processing providing control signals in both said first and second modes.

* * * * *